United States Patent [19]

MacDonald, Jr. et al.

[11] 3,988,990

[45] Nov. 2, 1976

[54] PROJECTILE

[75] Inventors: Hugh D. MacDonald, Jr., Cinnaminson, N.J.; Peter Tietz, Meppen, Germany

[73] Assignee: The United States of America as represented by the Secretary of the Army, Washington, D.C.

[22] Filed: Sept. 3, 1975

[21] Appl. No.: 610,029

[52] U.S. Cl. ..... 102/49.7; 102/60; 102/87

[51] Int. Cl.[2] ..... F42B 13/34

[58] Field of Search ..... 102/6, 39, 49.7, 60, 102/65, 66, 87, 90; 244/3.1

[56] References Cited

UNITED STATES PATENTS

| | | | |
|---|---|---|---|
| 3,724,377 | 4/1973 | Birkigt | 102/49.7 X |
| 3,780,658 | 12/1973 | Longueville et al. | 102/52 |
| 3,912,458 | 10/1975 | Fukuma et al. | 102/39 X |

FOREIGN PATENTS OR APPLICATIONS

| | | | |
|---|---|---|---|
| 843,979 | 4/1939 | France | 102/90 |

*Primary Examiner*—Verlin R. Pendegrass
*Attorney, Agent, or Firm*—Nathan Edelberg

[57] ABSTRACT

A projectile having a minimum of base drag effect and a maximum of velocity and range during its operational flight, as caused by a controlled propellant gas discharge through a porous disc in the base of the projectile. A rearwardly exhausting propellant gas generator is ignited by a pressure sensitive igniter. The igniter is actuated by the porous disc which is slidably mounted in the rearward end of the projectile and responsive to a cartridge propelling charge.

5 Claims, 1 Drawing Figure

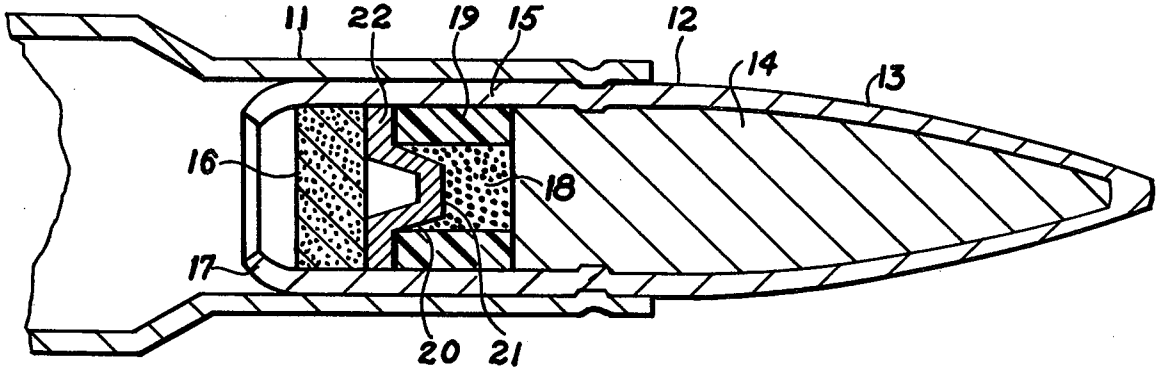
11
12
13
14
15
16
17
18
19
20
21
22

PROJECTILE

The invention described herein may be manufactured, used and licensed by or for the Government for governmental purposes without the payment to us of any royalty thereon.

Reduction of projectile base drag or body drag by any technique has been a persistent objective in gun system and projectile design.

It is an object of the invention to provide a projectile having a minimum base drag effect during its operationally accurate and stable flight.

Another object of the invention is to provide such a projectile having a maximum of flight velocity and range.

A further object of the invention is to provide such a projectile having a controlled diffused gas discharge through its base.

These and other objects, features and advantages will become more apparent from the following description and accompanying drawing which is a longitudinal sectional view of a cartridge ammunition projectile embodying the principles of the invention.

The preferred cartridge ammunition projectile arrangement has a suitable brass cartridge case 11 crimped to the steel projectile body or jacket 12, the forward nose portion 13 of which contains a lead slug or filler 14. The cylindrical sidewall portion 15 of the projectile body has its rearmost apertured end coned, after assembly of a gas generating unit and porous disc 16, to define an annular inwardly directed flange 17 that limits the rearward motion of the porous disc 16 of sintered tungsten which is slidably mounted in the projectile gas generating cavity. The propellant gas generating unit includes extruded or cast propellant 18 surrounded by a cylindrical polyester resin inhibitor 19 that is slidably seated in the cavity against the rearward surface of the slug 14. A cup-shaped pressure sensitive igniter 20 comprising a mix including lead styphanate and magnesium fluorocarbon material is positioned intermediate the gas generating unit and the porous disc 16. The base 21 of the igniter cup is in contact with the propellant 18 and the igniter 20 has an annular peripheral flange 22 that extends between and is in contact with the rearward surface of the inhibitor 19 and the forward surface of the porous disc 16.

Upon ignition of an appropriate propelling charge (not shown) within the cartridge case 11, generated pressure gas rapidly launches and accelerates the projectile out of a weapon barrel and also rapidly moves the disc forwardly to compress and fire the pressure sensitive igniter 20 to ignite the propellant 18. Hot gases from the burning propellant then move the disc rearwardly against the coned sealing flange 17 and are controllingly exhausted rearwardly through the porous disc 16 in a diffused and tortuous path. Preferably, the disc 16 is substantially 20 percent porous and it controls the combustion rate of the propellant and the internal pressure. The inhibitor 19 restricts combustion to the propellant rearward end surface. By venting gases from the rearward end of the projectile, the pressure of the environment stream behind the projectile is increased to reduce the base drag of the projectile during aerodynamic flight. As a result the range and velocity (particularly terminal) of the projectile are increased while maintaining its target accuracy.

Various modifications, alterations or changes may be resorted to without departing from the scope of the invention as defined in the appended claims.

We claim:

1. A projectile comprising, a projectile body having a forward nose portion and a substantially cylindrical sidewall portion, a metallic slug substantially filling said forward nose portion, propellant gas generating means in said body rearward of said slug, a pressure sensitive igniter in contact with said propellant gas generating means, and a porous disc slidably mounted in said body rearward of said igniter, said body sidewall portion having inwardly directed flange means at a rearmost end thereof.

2. The structure in accordance with claim 1 wherein said igniter is a cup-shaped member having a peripheral flange in contact with a forward surface of said porous disc.

3. The structure of claim 2 wherein said gas generating means includes extruded propellant surrounded by a cylindrical inhibitor, said inhibitor having a rearward surface in contact with said igniter peripheral flange.

4. The structure of claim 1 wherin said porous disc is of sintered tungsten material.

5. The structure of claim 4 wherin said igniter comprises a mix of lead styphnate and magnesium fluorocarbon material.

* * * * *